US006948897B2

(12) United States Patent
Lawton

(10) Patent No.: US 6,948,897 B2
(45) Date of Patent: Sep. 27, 2005

(54) SYSTEMS AND METHODS FOR ASSEMBLING AND BINDING PUBLICATIONS

(75) Inventor: Robert J. Lawton, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 288 days.

(21) Appl. No.: 10/007,524

(22) Filed: Nov. 8, 2001

(65) Prior Publication Data

US 2003/0086773 A1 May 8, 2003

(51) Int. Cl.[7] ..... B42B 9/00

(52) U.S. Cl. ..... 412/1; 270/52.08; 270/58.08; 281/21.1; 412/4; 412/8; 412/33

(58) Field of Search ..... 412/22, 1, 4, 5, 412/6, 8, 9, 16, 19, 33; 281/15.1, 21.1; 270/57.08, 52.08, 58.08

(56) References Cited

U.S. PATENT DOCUMENTS

| | | | | | |
|---|---|---|---|---|---|
| 4,525,116 | A | * | 6/1985 | Holmberg | 412/8 |
| 4,547,000 | A | * | 10/1985 | Sallinen | 281/23 |
| 4,975,011 | A | * | 12/1990 | Holmberg | 412/6 |
| 5,062,754 | A | * | 11/1991 | Bolin et al. | 412/4 |
| 5,975,823 | A | * | 11/1999 | Schlough | 412/8 |
| 6,572,318 | B2 | * | 6/2003 | Cobene et al. | 412/11 |
| 2002/0019029 | A1 | * | 2/2002 | Barnes et al. | 435/69.1 |
| 2003/0086773 | A1 | * | 5/2003 | Lawton | 412/1 |

* cited by examiner

*Primary Examiner*—Monica S. Carter

(57) ABSTRACT

A single sheet publication binding process utilizes media having an adhesive pre-applied to the media before the media is printed or bound within a publication. A publication page, or cover, has an adhesive pre-applied, is printed, and is then aligned in a publication binder. The publication binder aligns the cover and pages of a publication one page at a time and applies a pressure to each page for a period of time that will activate a pressure sensitive co-adhesive on the page with the co-adhesive on another page, or with the co-adhesive on the cover.

12 Claims, 9 Drawing Sheets

SYSTEMS AND METHODS FOR ASSEMBLING AND BINDING PUBLICATIONS

TECHNICAL FIELD

This invention relates to assembling and binding publications, and specifically to book binding.

BACKGROUND

Book binding is a process that typically requires expensive, high maintenance equipment. Particularly subject to high maintenance and often needed calibration is a guillotine cutter used to shear the three non-bound edges of a book after the pages and cover of the book have been assembled and glued.

A common book size is 6×9 inches. To print and assemble a 6×9 inch book, however, a printer typically has to begin with 8½×11 inch paper stock. Initially, the paper stock is printed and collated to form a book block. Next, a hot-melt glue is applied to the book block at the edge that will be bound and a book cover is wrapped around the book block.

To complete the process, the book is pressed with an apparatus to hold the pages and the cover of the book firmly in place while the guillotine cutter shears the three non-bound edges of the book. The guillotine cutter requires a heavy-duty frame, as well as regular maintenance and calibration to ensure that the edges of the pages and cover of the book are all cut evenly.

The book binding process is also susceptible to volatile fume emissions from the hot-melt glue which is warmed in a glue pot. Using a glue pot requires having an elaborate ventilation system to ensure the health safety of those involved in the book binding process.

Furthermore, applying the hot-melt glue to the edge of a book block is an imprecise operation. Often, excess glue material is applied to ensure complete coverage of a book's bound edge. The excess glue overflows and is wasted when the book and cover are pressed together, and is then cut off with the edges of the pages and cover of the book. Conversely, a book's cover will not wear well over an extended period of time if not enough glue is applied between the book block and the cover.

The following description discusses systems and methods to assemble and bind publications without using high maintenance equipment, oversized paper stock, and volatile hot-melt glue. Additionally, the systems and methods maintain the precise cover and page edge alignment expected of a bound publication.

SUMMARY

A single sheet publication binding process utilizes media, such as a book page, having an adhesive pre-applied to the media before the media is printed or bound within a publication. A publication page, or cover, has an adhesive applied, is printed, and is then aligned in a publication binder. The publication binder aligns the cover and pages of a publication one page at a time and applies a pressure to each page as it is assembled for binding.

The pressure is applied to the publication pages with a roller, or similar pressure applicator, for a period of time that will activate the pressure sensitive co-adhesive on the page with the co-adhesive on another page, or with the co-adhesive on the cover, to adhere the pages and/or the cover together.

BRIEF DESCRIPTION OF THE DRAWINGS

The same numbers are used throughout the drawings to reference like features and components.

DETAILED DESCRIPTION

Introduction

The following description describes systems and methods to prepare, assemble, and bind publications. In the described embodiments, the publication is a book. However, the systems and methods are also applicable to booklets, magazines, newspapers, journals, periodicals, pamphlets, and the like.

Additionally, in the described embodiments, a page or cover can be a sheet of paper, a piece of paper stock, or any similar material used when preparing, printing, assembling, and/or binding a publication. Although a publication "page" and a publication "cover" are distinguished herein, the following systems and methods apply to both equally.

Exemplary Publication Media

Figure 1:
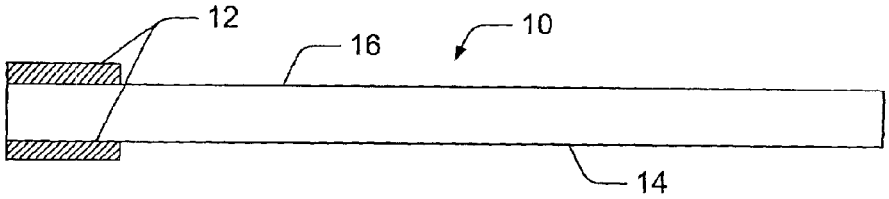
FIG. 1 is a side view of a publication page having an adhesive on both sides of the page at one end.

FIG. 1 shows an edge view of a publication page 10 having a pressure set adhesive 12 applied at one end. The adhesive 12 is applied to the front 14 and to the back 16 of the page 10. The adhesive 12 can be cohesively bound with another page, or with a cover, to form a publication such as a book.

The pressure set adhesive 12 can be applied to the page 10 before the page is even printed. This type of adhesive is well-known and can be applied by a manufacturer of the paper before the paper is delivered to a printer publisher. The adhesive 12 can be adhered to the paper within precise tolerances at a manufacturers' facility. Furthermore, the emissions from such an adhesive are negligible, or at least removed from a printer publishers' facility and concern.

The adhesive 12 is applied to pages before the pages are delivered to a printer publisher and printed. The adhesive is designed such that after being applied, it will not adhere to another page until activated. In the described implementation, the adhesive is activated by pressure. Specifically, the adhesive on a page forms a cohesive bond with an adhesive on another page when pressure is applied to press the two adhesives together over a period of time. The cohesive bond can also be temperature dependent. That is, the cohesive bond can be pressure, temperature, and time dependent. An effective pressure over time at room temperature can be determined to form the cohesive bond. This technology is well-known in the adhesive art.

Figure 2:
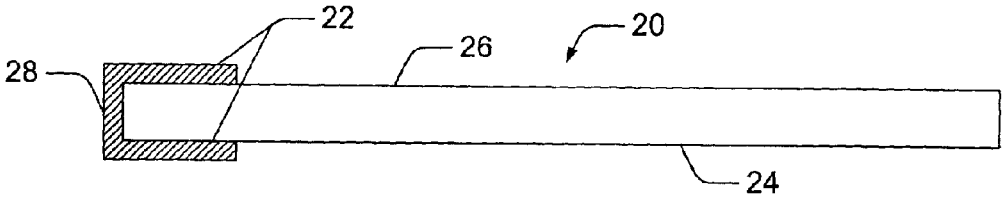
FIG. 2 is a side view of a publication page having an adhesive on both sides of the page at one end, and on the edge of the page.

FIG. 2 shows an edge view of a publication page 20 having a pressure set adhesive 22 applied at one end. The adhesive 22 is applied to the front 24 and to the back 26 of the page 20, similarly to the adhesive application shown in FIG. 1. In addition, pressure set adhesive 28 is applied to the edge of the page 20 at the same end. The difference in applying an adhesive to only the front and back of one end of the page as in FIG. 1, and also applying an adhesive to the edge of the page as in FIG. 2, will become apparent in the following discussion.

Figure 3:
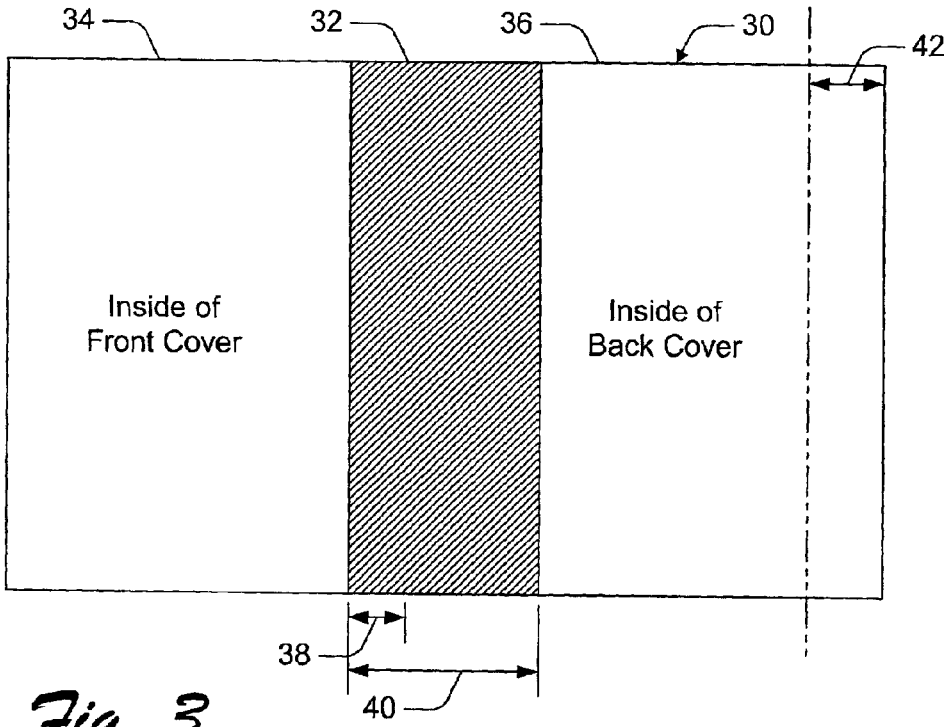
FIG. 3 is an illustration of a publication cover having an adhesive on the inside of the cover.

FIG. 3 shows a publication cover 30 having a pressure set adhesive 32 applied to the inside of the cover. The adhesive 32 is applied to the center of the inside of the cover 30 between what will become the inside of the front cover 34 and the inside of the back cover 36 when the cover 30 is bound with pages to form a publication. As with the pages described in FIGS. 1 and 2, the adhesive 32 is applied to the cover before the cover is delivered to a printer publisher.

The adhesive 32 is applied to the inside of the cover 30 to accommodate binding publications of varying thickness. For example, the cover 30 can be manufactured to bind a book having a thickness of 100 pages, as designated by a width of adhesive 38. In addition, the cover 30 can bind a book having a thickness of 300 pages, as designated by a width of adhesive 40. Any portion of adhesive 32 that does not contact an adhesive on a page when a publication is bound together, such as adhesive 12 or 22 on pages 10 and 20, respectively, would not be activated as part of the pressure sensitive cohesive bond formed between the pages and the cover of the publication.

A printer publisher can request any size cover to accommodate any maximum thickness of a book, yet print and use the cover to bind any thickness of a book less than the maximum thickness. The portion of the cover 30 designated by a width 42 can be trimmed or folded over as needed to accommodate covering a book having a thickness less than the maximum designed for any particular cover.

Exemplary Publication Binding Systems

Figure 4:
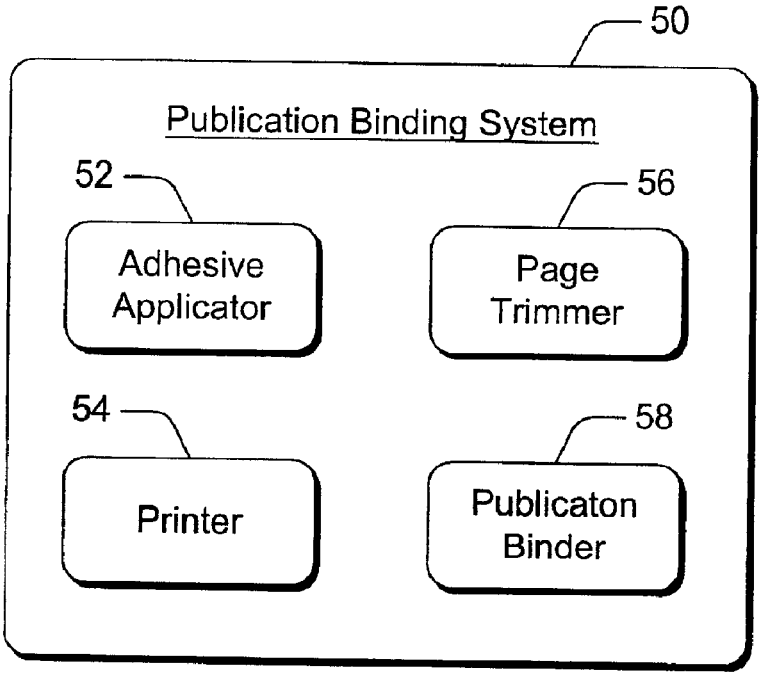
FIG. 4 shows a block diagram of a publication binding system.

FIG. 4 shows a publication binding system 50 having an adhesive applicator 52, a printer 54, a page trimmer 56, and a publication binder 58. The adhesive applicator 52 applies the pressure set adhesive 12 to page 10 (FIG. 1), the pressure set adhesive 22 to page 20 (FIG. 2), and the pressure set adhesive 32 to the cover 30 (FIG. 3), for example. The printer 54 prints publication pages and covers and the page trimmer 56 trims the pages and covers, if needed. The publication binder 58 aligns a cover and pages of a publication one page at a time and applies a pressure to each page as it is assembled for binding to activate the pressure set adhesive.

In the described embodiments, the preparing and binding of a publication is described in the order of an adhesive applied to a page with the adhesive applicator 52, the page is printed with the printer 54 and then trimmed with the page trimmer 56, if needed, and the page is then bound with a publication in the publication binder 58. The adhesive can be applied to a page by a manufacturer of the paper before the paper is delivered to a printer publisher where the page is then printed, trimmed, and bound with a publication. However, other scenarios for preparing and binding a publication can be implemented. For example, a page can be printed and trimmed before the adhesive is applied and can then be bound with a publication. Alternatively, a page can be trimmed, printed, have the adhesive applied, and can then be bound with a publication.

Figure 5:
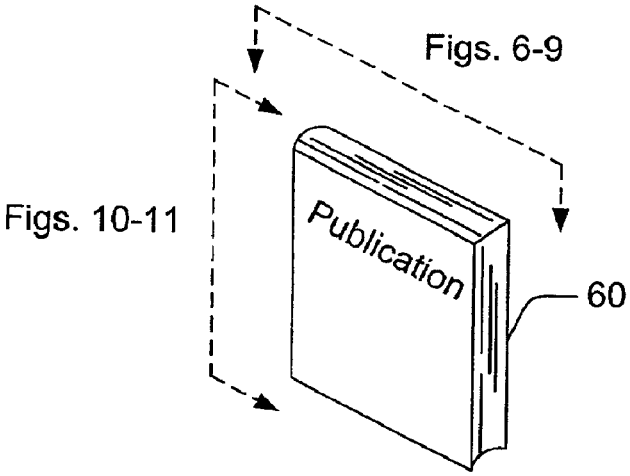
FIG. 5 illustrates an orientation guide for viewing the perspectives of a publication shown in FIGS. 6 through 10.

FIG. 5 illustrates a publication 60 produced with the publication binding system 50. The publication 60 is used as an orientation guide to illustrate the perspectives of FIGS. 6 through 11.

Figure 6:
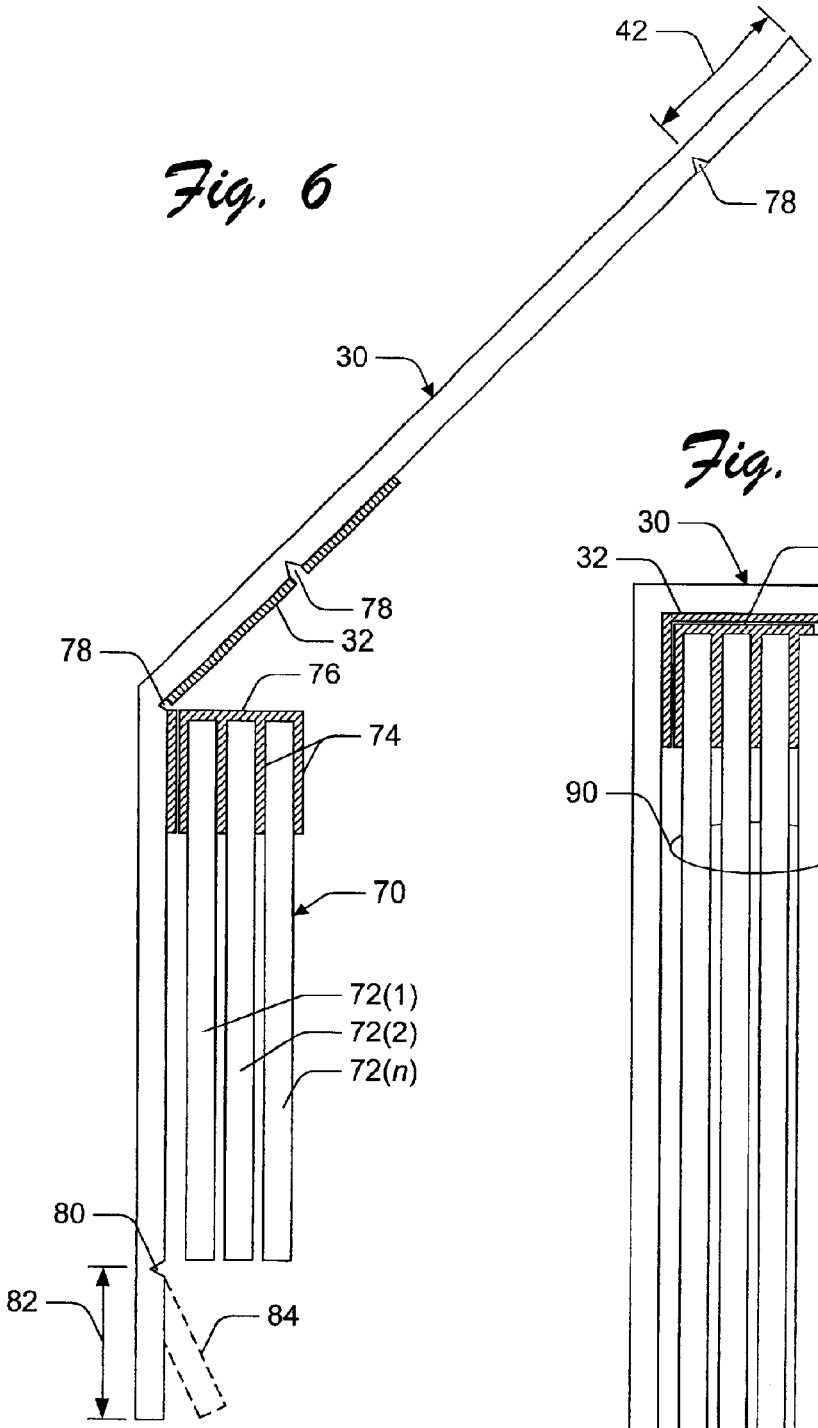
FIG. 6 is a top edge view of publication pages and the cover shown in FIG. 3.

FIG. 6 is a top edge view of the publication cover 30 and a book block 70. The book block 70 consists of pages 72(1 . . . *n*) that are pressed together. For clarification, the front of a page 72 is to the left of the drawing, the back of a page 72 is to the right, and the binding end is to the top of the drawing. An adhesive 74 is applied to the front and back of one end of the pages 72(1 . . . *n*) to adhere the pages together. An adhesive 76 is applied to the edge of the pages at the same end to facilitate adhering to the cover 30. In this way, the pages 72(1 . . . *n*) illustrate an embodiment of the page 20 shown in FIG. 2.

The adhesive 76 on the edge of the pages 72(1 . . . *n*) forms a cohesive bond with the adhesive 32 applied to the inside of the cover 30 when the cover is folded around the book block 70 and the adhesive is activated with a pressure over a period of time. As illustrated, the cover adhesive 32 can also be adhered to the adhesive on the front of the first page 72(1) and adhered to the adhesive on the back of the last page **72(*n*) when the cover 30 is wrapped around the book block 70**.

The publication cover 30 is shown having been scored at each location of a horizontal fold 78 and 80 in the cover. Scoring the cover 30 at the folds 78 and 80 allows the cover to be folded more precisely when binding a publication. The portion of the cover 30 that can be trimmed or folded over as needed is designated by the width 42 in both FIGS. 3 and 6. Similarly, the portion of the cover 30 designated by a width 82 in FIG. 6 can be trimmed or folded over. The folded section 84 of the cover 30 is illustrated as portion 82 being folded at the scored location 80. The folded section 84 can be folded back against the inside of the front of the cover, or it can be folded into the pages 72(1 . . . *n*) and utilized as a bookmark.

Figure 7:
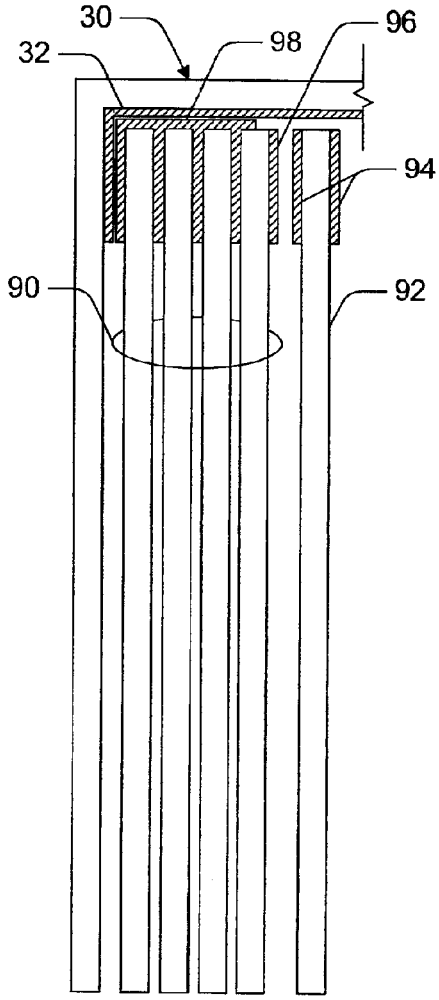
FIG. 7 is a top edge view of publication pages and a cover.

FIG. 7 is a top edge view of the publication cover 30 and a book block 90 consisting of multiple pages. Page 92 is the next page to be added to the book block 90. Page 92 has an adhesive 94 applied to the front and back of one end of the page which illustrates an embodiment of the page 10 shown in FIG. 1. When page 92 is pressed with book block 90, adhesive 94 is activated to form a cohesive bond with the adhesive 96 on the back of the book block 90. The adhesive 96 and adhesive 94 on page 92 "donates" glue for the end or edge binding of the publication when pressed together. That is, the process of adding a new page 92 forces extra adhesive 98 out to the edge of the book block 90 to be adhered to the adhesive 32 on the inside of the cover 30.

Figure 8:
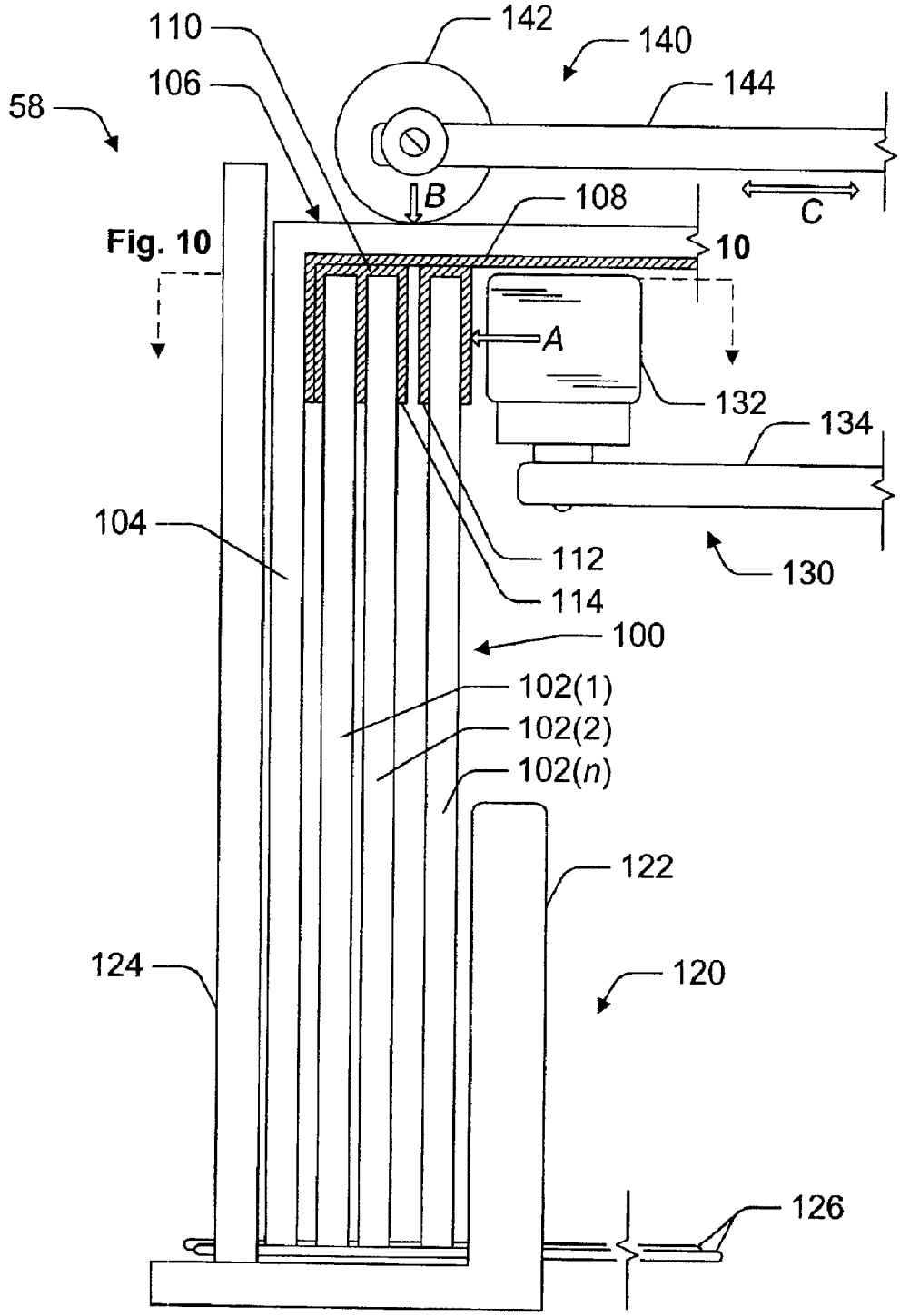
FIG. 8 is a top edge view of publication pages and a cover in a publication binder.

FIG. 8 illustrates a publication binder 58 and a partially bound publication 100 having pages 102(1 . . . *n*) and a cover 104. The cover 104 has a binding edge 106 to be bound with pages 102(1 . . . *n*), and an adhesive 108 on the inside of the cover. An adhesive 110 is applied to an edge of pages 102(1 . . . *n*) to be joined with the adhesive 108 on the inside of the cover 104. Pages 102(1) and 102(2) are shown bound together and page 102(*n*) is in a position to be bound with pages 102(1,2). The front of page 102(*n*) has an adhesive 112 to adhere with the adhesive 114 on the back of page 102(2).

The publication binder 58 has an alignment system 120 to align consecutive pages, or a page with a cover. In the illustrated example, page 102(*n*) is aligned with page 102(2) in a position to be bound with pages 102(1,2). The alignment system 120 has a clamp 122 and a support 124 to secure the cover 104 and pages 102(1 . . . *n*) in position to be bound. The alignment system 120 also has pins 126 to align the cover 104 and pages 102(1 . . . *n*). Any configuration and number of clamps, supports, pins, and the like can be used to precisely align a cover and pages of a publication before binding.

The publication binder 58 also has a pressure system 130 to apply a pressure to the back of page 102(*n*) for a period of time that will adhere the adhesive 112 on the front of the page 102(*n*) with the adhesive 114 on the back of page 102(2). The pressure system 130 has a roller 132 and a roller attachment mechanism 134 to apply a pressure in a direction identified by arrow A while translating the roller 132 in directions perpendicular to the plane of FIG. 8.

The publication binder 58 has a second pressure system 140 to apply a pressure to the binding edge 106 of the cover 104 for a period of time that will adhere the adhesive 108 on the inside of the cover with the adhesive 110 on the edges of the pages 102(1 . . . *n*). The pressure system 140 has a roller 142 and a roller attachment mechanism 144 to apply a pressure in a direction identified by arrow B while translating the roller 142 in directions identified by arrows C.

Figure 9:
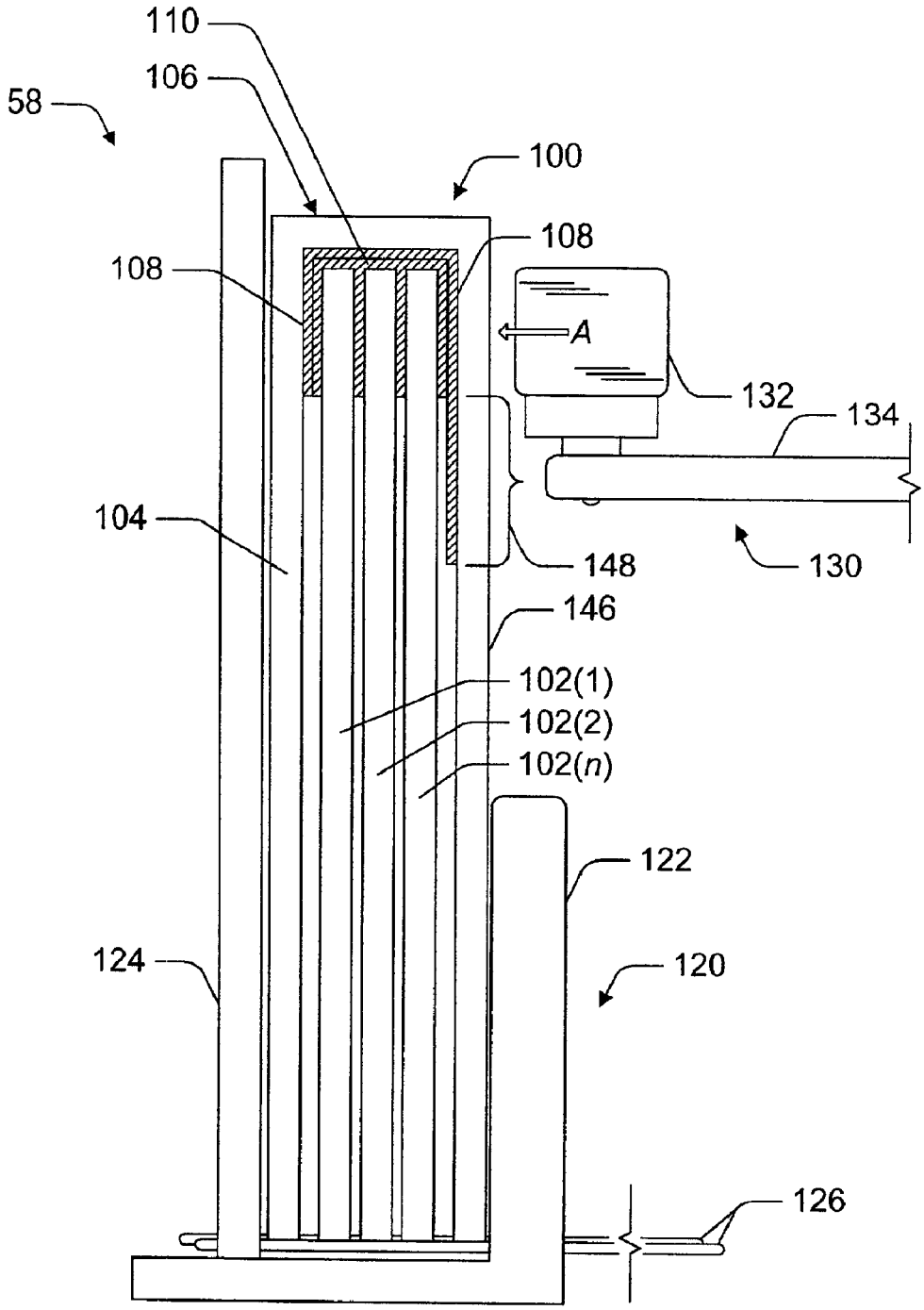
FIG. 9 is a top edge view of publication pages and a cover in a publication binder.

FIG. 9 illustrates the publication binder 58 shown in FIG. 8 with a back section 146 of cover 104 positioned to be bound with pages 102(1 . . . *n*) to form the bound publication 100. The adhesive 108 on the inside of the back section 146 of cover 104 adheres to the adhesive on the back of page 102(*n*). The portion of adhesive 108 indicated by bracket 148 is adhesive that does not contact an adhesive on page 102(*n*) when the publication 100 is bound together, and is not activated as part of the pressure sensitive cohesive bond formed between the page and the cover of the publication.

The pressure system 130 applies a pressure to the back of the cover for a period of time that will adhere the adhesive 108 on the inside of the back section 146 of cover 104 to the adhesive on the back of page 102(*n*). The roller 132 and roller attachment mechanism 134 operate to apply the pressure in a direction identified by arrow A while translating the roller 132 in directions perpendicular to the plane of FIG. 9.

Figure 10:
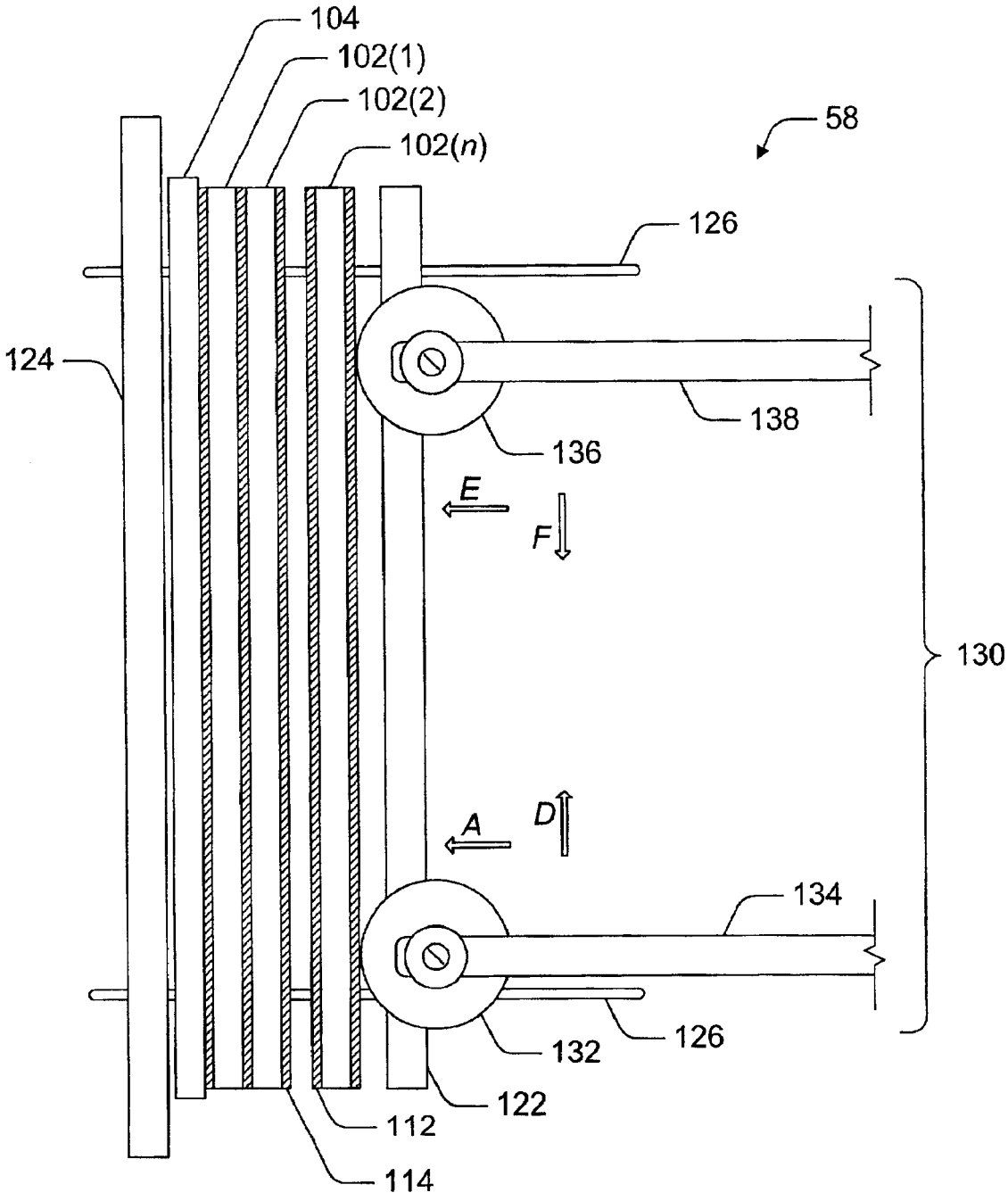
FIG. 10 is a top view of a publication binder as illustrated in FIG. 7, and a top view of a bound edge of a publication.

FIG. 10 is a top view of the publication binder 58 shown in FIG. 8. For reference, this is also a view from the top of a bound edge of a publication (see FIG. 5). The pressure system 130 shown in FIG. 8 is also shown in FIG. 9 positioned to apply a pressure identified by arrow A with roller 132 to the back of page 102(*n*). The roller 132 applies the pressure to page 102(*n*) while moving from an outside edge of the page towards the center of the page in a direction identified by arrow D.

While a single roller 132 will activate the adhesive and bind the pages, the pressure system 130 can also include a second roller 136 and a roller attachment mechanism 138. The second roller 136 is positioned to apply a pressure identified by arrow E to the back of page 102(*n*). The second roller 136 applies the pressure to page 102(*n*) while moving from an outside edge of the page towards the center of the page in a direction identified by arrow F. Utilizing the two rollers 132 and 136 will press the adhesive, such as adhesive 112 and 114 to the center of the bound edge of a publication, rather than pressing any adhesive beyond the edges of the publication.

Figure 11:
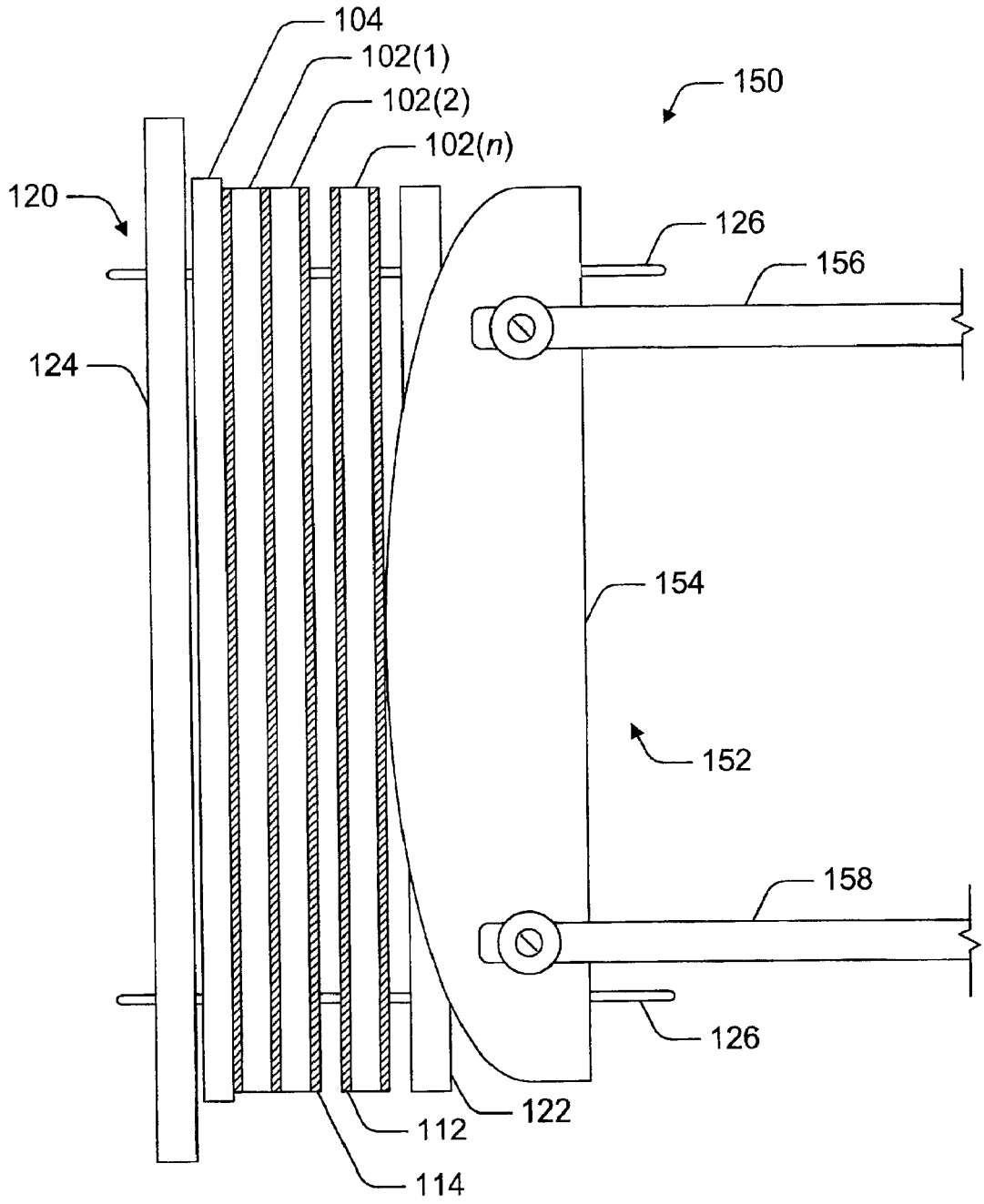
FIG. 11 is a top view of a publication binder and a top view of a bound edge of a publication.

FIG. 11 is a top view of a publication binder 150 which is an alternative embodiment of publication binder 58 shown in FIGS. 8–10. The same components of an alignment system 120 are shown including a clamp 122 and a support 124 to secure the cover 104 and pages 102(1 . . . *n*) in a position to be bound. Also shown are pins 126 to align the cover 104 and pages 102(1 . . . *n*).

Publication binder 150 has an alternate embodiment of a pressure system 152 to apply a pressure to the back of page 102(*n*) such that the adhesive 112 on the front of page 102(*n*) adheres to the adhesive 114 on the back of page 102(2). The pressure system 152 has a rocking pressure applicator 154 that is actuated by attachment mechanisms 156 and 158. The attachment mechanisms 156 and 158 are operably connected to the pressure applicator 154 and operate to rock the applicator 154 to apply a pressure along the back of page 102(*n*).

Exemplary Publication Media

Figure 12:
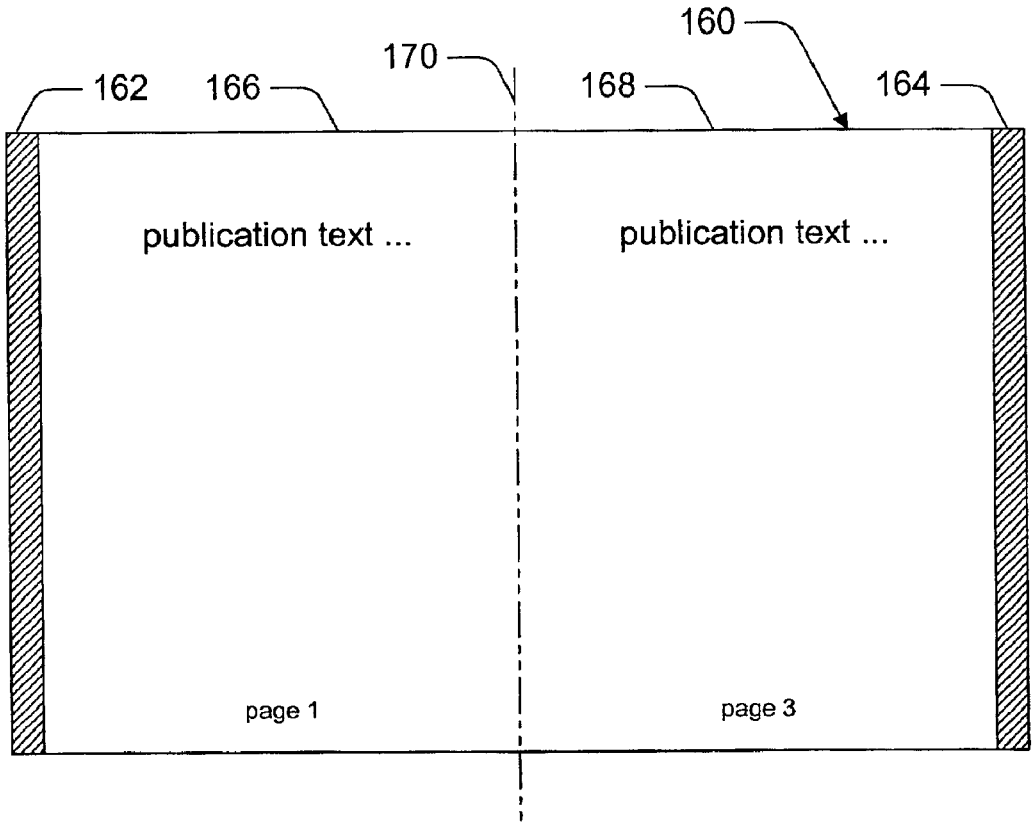
FIG. 12 is an illustration of a publication page having an adhesive on both ends of the page for double parallel printing.

FIG. 12 shows a publication page 160 having a pressure set adhesive 162 and 164 applied to both ends of the page for double parallel printing. Similarly to the pages described in FIGS. 1 and 2, the adhesive 162 and 164 can be applied to the page 160 before the page is delivered to a printer publisher and printed. When printed, the page 160 will be printed as two pages 166 and 168 connected at a center line 170. The page 160 is cut at the center line 170 before the two pages 166 and 168 are orientated and assembled to be bound with a publication.

When page 160 is cut after printing to form the two pages 166 and 168, the two pages can have the adhesive on the front and the back of one end of the page as shown in FIG. 1. Alternatively, the two pages can have the adhesive on the front, back, and edge of the page as shown in FIG. 2.

Page 160 can also be manufactured for double parallel printing with the adhesive applied at the center 170 of the page. When page 160 is cut after printing to form the two pages 166 and 168, the two pages can have the adhesive on the front and the back of one end of the page as shown in FIG. 1. The cut edge along what was the center 170 of the page 160 before being cut would not have an adhesive applied to it.

Methods for Publication Binding

Figure 13:
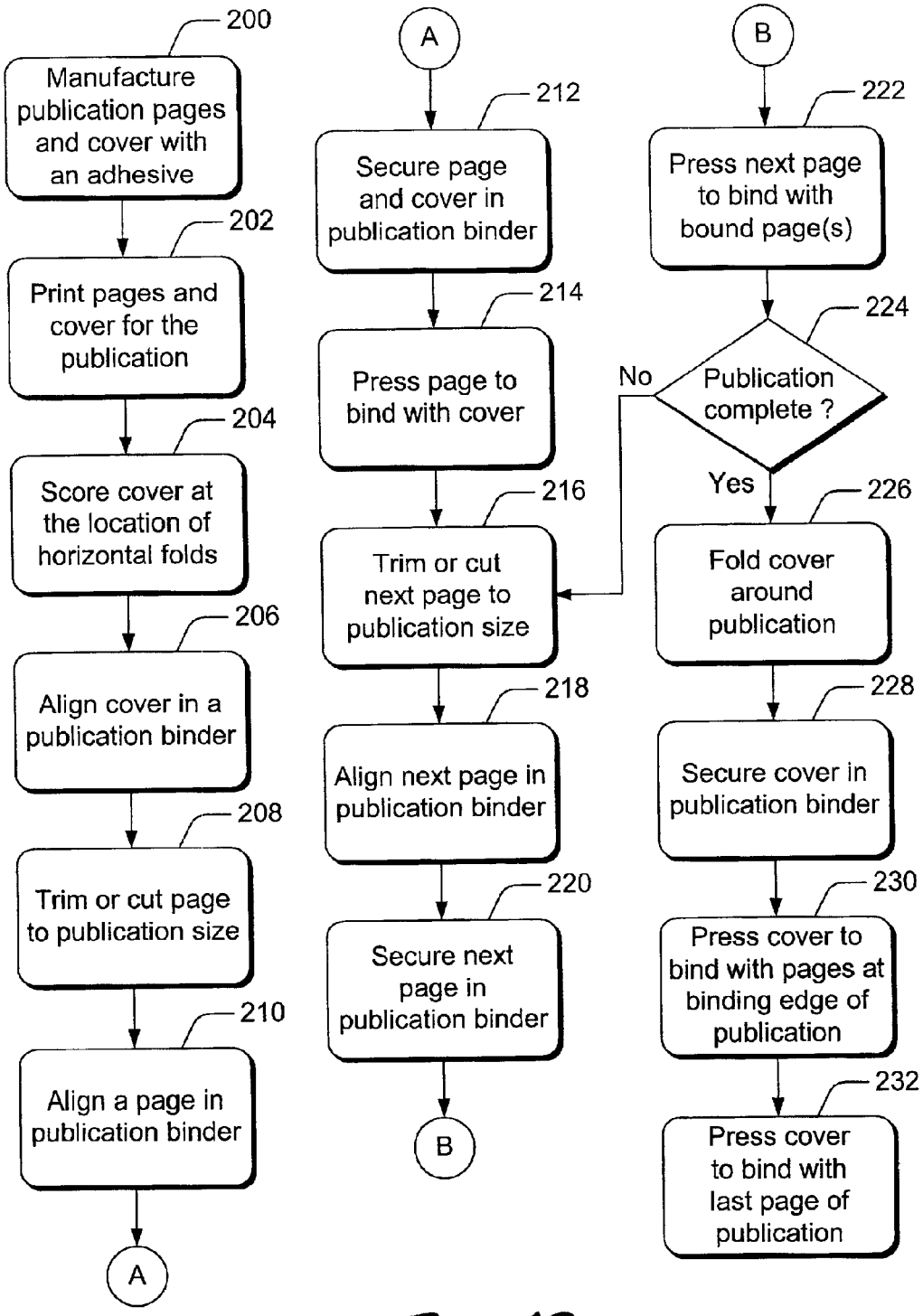
FIG. 13 is a flow diagram that describes a method to assemble and bind a publication one page at a time.

FIG. 13 is a flow diagram that describes a method to assemble and bind a publication one page at a time. The order in which the method is described is not intended to be construed as a limitation. At block 200, the pages for a publication, and the cover, are manufactured with a pressure set adhesive applied to the top and bottom of the page on one end. The adhesive can also be applied to the edge of the page at the same end as shown in FIG. 2. Alternatively, the adhesive can be applied to the pages as described with reference to FIG. 12 to facilitate double parallel printing.

At block 202, the pages and the cover are printed. At block 204, the cover of the publication is scored at each location that a horizontal fold will be made when the cover is folded around to bind the publication pages. The cover is then aligned in a publication binder at block 206.

At block 208, a page is cut or trimmed, if needed, to the size of the publication and then the page is aligned in the publication binder at block 210. At block 212, the page and cover are secured in place after being aligned in the publication binder. At block 214, the page is pressed by rotating a roller, or other pressure applicator, over the adhesive end of the page for a period of time to activate the adhesive on the page and form a cohesive bond with the adhesive on the cover.

At block 216, another page is trimmed or cut, if needed, to the size of the publication. The page is then aligned in the publication binder at block 218 and secured in place at block

220. The page is pressed at block 222 as described above to activate the adhesive on the page and form a cohesive bond with the adhesive on the previously bound page. At block 224, the process of trimming or cutting a page, aligning the page in the publication binder, securing the page, and pressing the page to adhere it to the already bound pages (blocks 216–222) is repeated until the publication is complete.

At block 226, the cover is folded around the publication and secured in place at block 228. The binding edge of the cover is then pressed at block 230 by rotating a roller over the bound end of the publication for a period of time to activate the adhesive on the inside of the cover and form a cohesive bond with the adhesive on the binding edge of the pages. At block 232, the back of the cover is pressed for a period of time to activate the adhesive on the inside of the back cover and form a cohesive bond with the adhesive on the back of the last page of the publication.

Conclusion

The systems and methods described herein to assemble and bind a publication offers a printer publisher multiple benefits over conventional binding processes. The benefits include a savings of material costs for adhesives, paper, and equipment. The size of paper can be specified in advance of printing for the applicable size of a publication. This eliminates the cost of having to print oversized paper stock and then trimming it down to publication size. Additionally, the publication binding system described herein provides a better binding technique over the traditional glue method because the cohesive contact area between pages and/or a cover is increased which improves page tear-out strength.

Applying an adhesive to the paper stock before printing reduces the cost of excess waste, and eliminates the expense of ventilation systems to vent hot-glue emissions. Without the noxious fume emissions from the adhesive, a publication binding system can be operated in a typical store or office, or at any location that a printer publisher seeks to implement a publication binding system.

Other benefits include low maintenance and calibration costs for smaller and lower power equipment used to assemble and bind publications. With the single sheet binding process, the equipment is not subjected to excessive stresses and pressures such as with a guillotine cutter having to cut several hundred pages of a publication at one time. Furthermore, the printing, trimming, and binding can be implemented as an automated inline system to further reduce publication production costs.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A method, comprising:

aligning a first page of a publication with a second page, the first and second pages having a pre-applied adhesive; and pressing the first page against the second page to activate the adhesive on the first and second pages, wherein a cohesive bond is formed between the adhesive on the first page and the adhesive on the second page, wherein pressing comprises:

rotating a first roller over the first page from a first outside edge of the page towards a center of the page;

rotating a second roller over the first page from a second outside edge of the page towards the center of the page, the second outside edge being opposite the first outside edge; and wherein the first and second rollers apply a pressure for a period of time that will activate the adhesive and form the cohesive bond.

2. A method as recited in claim 1, further comprising trimming the first and second pages before aligning.

3. A method as recited in claim 1, further comprising trimming the first and second pages together.

4. A method as recited in claim 1, further comprising securing the first and second pages in place before pressing.

5. A method as recited in claim 1, further comprising applying the adhesive on a binding edge of the first and second pages before aligning.

6. A method as recited in claim 1, further comprising applying the adhesive to a top and a bottom on one end of the first and second pages before aligning.

7. A method comprising:

aligning a first page of a publication with a second page, the first and second pages having a pre-applied adhesive;

pressing the first page against the second page to activate the adhesive on the first and second pages, wherein a cohesive bond is formed between the adhesive on the first page and the adhesive on the second page; and aligning a cover with the first page, the cover having a pre-applied adhesive and scoring an inside of the cover at each location of a horizontal fold;

wherein pressing comprises:

rotating a first roller over the first page from a first outside edge of the page towards a center of the page;

rotating a second roller over the first page from a second outside edge of the page towards the center of the page, the second outside edge being opposite the first outside edge; and wherein the first and second rollers apply a pressure for a period of time that will activate the adhesive and form the cohesive bond.

8. A method as recited in claim 7, wherein pressing the cover comprises rotating a roller over the cover to apply a pressure for a period of time that will activate the adhesive and form the cohesive bond.

9. A publication binder, comprising:

an alignment system configured to align a first page of a publication with a second page; and a pressure system configured to apply a pressure to the first page for a period of time that will adhere an adhesive on the first page with an adhesive on the second page, the pressure system including:

a first roller configured to apply the pressure to the first page from a first outside edge of the page towards a center of the page; and a second roller configured to apply the pressure to the first page from a second outside edge of the page towards the center of the page, the second outside edge being opposite the first outside edge.

10. A publication binder as recited in claim 9, wherein the alignment system is configured to align a cover with the first page, the publication binder further comprising a pressure system configured to apply a pressure to the cover for a period of time that will adhere an adhesive on the cover with the adhesive on the first page.

11. A publication binder as recited in claim 9, wherein the alignment system includes a clamp configured to secure the first and second pages in place.

12. A publication binder as recited in claim 9, further comprising a trimmer configured to trim pages and a cover of the publication.

* * * * *